US008313007B2

(12) United States Patent
Kpabar

(10) Patent No.: US 8,313,007 B2
(45) Date of Patent: Nov. 20, 2012

(54) PORTABLE MULTIPURPOSE FOOD AND BEVERAGE INSULATED CONTAINER AND INSULATED WATER DISPENSING ALTERNATIVE

(76) Inventor: Thomas Kolaco Kpabar, Hampton, VA (US)

( * ) Notice: Subject to any disclaimer, the term of this patent is extended or adjusted under 35 U.S.C. 154(b) by 521 days.

(21) Appl. No.: 12/586,821

(22) Filed: Sep. 29, 2009

(65) Prior Publication Data

US 2010/0078448 A1 Apr. 1, 2010

Related U.S. Application Data

(60) Provisional application No. 61/194,604, filed on Sep. 29, 2008.

(51) Int. Cl.
*B67D 1/16* (2006.01)
*B67D 7/06* (2010.01)

(52) U.S. Cl. ..... 222/108; 222/130; 222/131; 222/146.6; 222/183; 222/185.1; 62/336; 62/389; 62/400; 220/592.18

(58) Field of Classification Search ..... 222/108, 222/146.6, 183, 185.1, 130, 131, 173; 62/336, 62/389, 396, 398, 400; 220/592.16–592.2
See application file for complete search history.

(56) References Cited

U.S. PATENT DOCUMENTS

| | | | | |
|---|---|---|---|---|
| 473,006 | A * | 4/1892 | Iler | 222/478 |
| 2,063,171 | A * | 12/1936 | Kucher | 62/390 |
| 5,537,838 | A * | 7/1996 | Mills et al. | 62/400 |
| 5,660,307 | A * | 8/1997 | Schroeder et al. | 222/108 |
| 5,671,611 | A | 9/1997 | Quigley | |
| 6,827,243 | B1 * | 12/2004 | Nuzzolese | 222/628 |
| 7,137,533 | B1 * | 11/2006 | Heath | 222/166 |
| 7,188,749 | B2 | 3/2007 | Miller | |
| 7,269,969 | B2 | 9/2007 | Strickland | |
| 7,275,662 | B1 | 10/2007 | Milcetich | |
| 7,861,646 | B2 * | 1/2011 | Bockbrader | 99/323.3 |

OTHER PUBLICATIONS

Thomas Kpabar, Jr. "Affordable Water Dispensing Solution" Oct. 7, 2007.*
Thomas Kpabar, Jr. "Energy Efficient Heating and Cooling" Jan. 10, 2008.*
Thomas Kpabar, Jr. "Affordable Water Dispensing Solution," Oct. 7, 2007, http://www.virtualrealimagine.com/Waterdispenser.html.
Thomas Kpabar, Jr. "Energy Efficient Heating and Cooling: Applications Designed with Thermoelectric Assist.," Jan. 10, 2008, http://www.virtualrealimagine.com/Newsletter.html.

* cited by examiner

*Primary Examiner* — J. Casimer Jacyna

(57) ABSTRACT

The portable multipurpose food and beverage insulated container and water dispensing alternative consists of the cooler body, a press fit top lid, a content support assemblage, a cup support assemblage, a nozzle access door and rubber skid strips. The cooler body is a rigid plastic multilayer housing with thermal insulator foam deposited between the general plainer outer shell and inner shell for reducing heat transfer through the cooler body. The press fit lid covers the top of the cooler body. The plastic content support assemblage supports the weight of the unit's contents in one of two possible orientations and collects condensate from the ice pack and or content defrosting. The cup support assemblage seats cups on a level surface and captures spills during water dispensing. The nozzle access door positioned on the frontal face of the cooler body opens to allow access to the water container's nozzle.

1 Claim, 11 Drawing Sheets

PORTABLE MULTIPURPOSE FOOD AND BEVERAGE INSULATED CONTAINER AND INSULATED WATER DISPENSING ALTERNATIVE

CROSS REFERENCE TO RELATED APPLICATIONS

This application claims the benefits of U.S. Provisional Patent Application 61/194,604 filled on Sep. 29, 2008.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The present invention relates to a portable multipurpose food and beverage insulated container and insulated water dispensing alternative. More specifically the invention is a portable insulated container consisting of the cooler body which has a compartment for storing a dimensionally appropriate, water container, a press fit lid that seals the top opening of the cooler body, a content support assemblage that fits inside the cooler body compartment who subcomponents, by adjustment, facilitates the accommodation of either water dispensing mode or food and beverage containing mode of usage, a cup support and spill reservoir assemblage, a frontally position nozzle or spigot access door with magnetic closure function that provides convenient access to the dimensionally appropriate water container's nozzle or spigot, a door latching mechanism that secures the nozzle or spigot access door in its closed position and rubber skid strips on the bottom outer surface of the cooler body to prevent excessive and undesired movement of the cooler body when said cooler body's exterior bottom structure is place on a smooth surface.

2. Description of Prior Art

Appropriate water consumption, as recommended by medical professionals, is a healthy and smart idea. However, consuming approximately eight glasses of water per day can be a hassle if the nearest water dispenser is located across the hall, down the stairs, in the vending area or at a near by store. Even more displeasing is the need to use a bathroom faucet in the absence of a designated kitchen area at a place of business or an educational institution. The lack of convenience and the health concerns associated with water consumption at public fountains can causes the "putting off" of drinking until one is near a more appetizing water supply. Consequently, valuable time is waste in search of a satisfactory and refreshing glass of water in the absence of a near-by water dispenser. Though many companies offer a convenient and healthy mechanical water dispending solution; the cost associated with maintenance, equipment rental, electricity supply, specialized water containers and their delivery scheduling makes the aforementioned dispenser options either unaffordable or impractical. Furthermore, justifying the cost of expensive water dispensing units is difficult for an individual or groups that do not require the presence of a water dispenser at all times. A portable not electric powered water dispensing unit is needed to address the need for a convenient affordable and sanitary water dispensing solution for the home, and/or workplace in general. The ideal embodiment would have minimal parts, be portable, easy to assemble, easy to disassemble, utilize a readily available off the grocers shelf water container, facilitate concealing of the aforementioned container when the unit is unattended, and can be use as a stand alone cooler, similar to those cooler that are sometimes referred to as ice chest, when not being used for water dispensing purposes. Such a solution externally would resemble a common non-electric-powered insulated cooler or ice chest but would be differentiated mainly by its frontally positioned inner-content's access door or nozzle or spigot access door similar to those doors found on refrigerator and electrical powered food and beverage cooling devices.

Provisions should be incorporated in the design of the water dispenser alternative for a cup supporting device that is design to prevent water spillage during water dispensing operation and a meshed tilted water bottle support system for inducing the desired directional fluid flow in the water container it supports. In addition, the cup support device should be designed such that it is detachable so as to avoid being an obstruction when the unit is being used as a food and beverage cooler which might be placed on the ground during picnicking or a gym floor at a sporting event. In addition, the ideal embodiment would provide sufficient access to the compartment of the cooler body which is designed for storing the dimensionally appropriate water container or food and beverages as well as the single or multiple ice packs that might be present in the said compartment during either cooler or dispenser mode of the invention's usage.

Several inventions have attempted to incorporate all of the features described above and were not successfully for various reasons. For example U.S. Pat. No. 7,269,969 issued on Sep. 18, 2007 to Strickland, et al. discloses a circular portable cooler unit that is capable of containing food and beverage in an insulated and enclosed environment along with acting as a water dispenser with transportation lifting handles and cup support attachments. However the patent issued to Strickland, et al. does not disclose a component for capturing spills during fluid dispensing operation of the cooler or a frontally positioned content access door.

U.S. Pat. No. 5,671,611 issued on Sep. 30, 1997 to Quigley discloses a rectangular cooler unit with compartments for storing food and beverages along with coolant in the form or ice. The disclosed invention is equipped with means to seal the aforementioned compartments from the ambient air temperature. The patent to Quigley does not disclose a cooler designed for drinking water dispensing and the usage of an ice pack rather than ice cubes as the cooling source or a frontally positioned content access door.

U.S. Pat. No. 7,188,749 issued on Mar. 13, 2007 to Miller, et al. discloses a container for holding a liquid storage vessel capable of dispensing fluid through a nozzle. The patent to Miller, et al. does not disclose a container capable of insulating its content or providing mean with in its embodiment for insulating its content. In addition, the patent to Miller, et al. does not describe a container capable of storing food or beverages other than the beverage held within its disclosed liquid storage vessel.

U.S. Pat. No. 7,275,662 issued on Oct. 2, 2007 to Milcetich discloses a device for supporting a bottle with nozzle or spigot at an angle on a shelf or refrigerator such that the angle causes the water inside of the bottle to concentrate around the bottle's nozzle of spigot so as to increase the water flow rate through the nozzle or spigot opening. The patent to Milcetich does not disclose a bottle support rack device that can be place in a cooler which permits access to the pressurized fluid at the nozzle or spigot opening.

SUMMARY OF THE INVENTION

The present invention relates generally to a portable multipurpose food and beverage insulated container and insulated water dispensing alternative capable of storing in an enclosed space; a Dimensionally Appropriate Water Container and when adjusted, by removing the Non-Slip Surface Tilted Water Bottle Support Rack from its position on top of the Content Support Assemblage, converts to the cooler mode which is capable of storing foods and beverages in the same aforementioned enclosed space. More specifically the invention is a portable insulated container consisting of the Cooler Body, Press Fit Lid, a Content Support Assemblage, a Cup Support and Spill Reservoir Assemblage, and a Nozzle or Spigot Access Door with magnetic closure function and Rubber Skid Strips. The Cooler Body is a suitable rigid plastic multilayer housing with a thermal insulator deposited between the general plainer outer shell and inner shell for reducing heat transfer through the plastic Cooler Body. The plastic Press Fit Lid covers the top of the Cooler Body. The plastic Content Support Assemblage supports the weight of the cooler's contents in one of two possible orientating modes and collects condensate. The Cup Support and Spill Reservoir Assemblage seats cups and captures spilled water during water dispensing mode. The Nozzle or Spigot Access Door positioned on the lower section of the frontal face of the Cooler Body opens to allow access to a Dimensionally Appropriate Water Container's nozzle for water dispensing. Rubber Skid Strips attached to the bottom exterior surface of the Cooler Body reduces unwanted movement of the Cooler Body.

Accordingly, it is a principle object of the inventor to provide a portable multipurpose food and beverage cooler/insulated container and insulated water dispensing alternative capable of holding a commercially available rigid plastic Dimensionally Appropriate Water Container, whose dimensions do not exceed the Cooler Body content storage envelope, in a position that allows water to dispense more easily.

It is another object of the invention to provide an insulated storage container with the above attributes that is capable of converting to a cooler whose interior is suitable for containing foods and beverages on a leveled surface.

It is a further object of the invention to provide an insulated storage container with the above attributes that has an attachable and detachable or removable member which facilitates the supporting of a cup.

It is a further object of the invention to provide an insulated storage container with the above attributes that has a door, which when opened, permits access to the nozzle or spigot of the stored Dimensionally Appropriate Water Container.

It is a further object of the invention to provide an insulated storage container with the above attributes that has a single Nozzle or Spigot Access Door which is fastened to the Cooler Body by a hinge mechanism that facilitates at least a 90 degree rotation of said Nozzle or Spigot Access Door off of the Cooler Body so that the fluid flow path, formed when the spigot or nozzle is opened to permit fluid flow, intersects the empty planar surface unconcealed by the said door being open, allowing direct access to the Dimensionally Appropriate Water Container's Nozzle or Spigot.

It is a further object of the invention to provide an insulated storage container with the above attributes whose Nozzle or Spigot Access Door, when closed, seals the lower opening of the Cooler Body by means of the contact between a metallic Nozzle or Spigot Access Door frame which is rigidly connected to the Cooler Body and a Magnetic Nozzle or Spigot Access Door Gasket that is rigidly connected to the cooler's Nozzle or Spigot Access Door.

It is a further object of the invention to provide an insulated storage container with the above attributes whose Nozzle or Spigot Access Door when closed can be secured in the closed position by a Nozzle or Spigot Access Door latch mechanism that has its latching component rigidly fastened to the Cooler Body and its notching component rigidly fastened to the cooler's Nozzle or Spigot Access Door.

It is a further object of the invention to provide an insulated storage container with the above attributes that has a single top opening which can be covered by a Press Fit Lid.

It is a further object of the invention to provide an insulated storage container with the above attributes that has handles mounted on the Cooler Body's for the purpose of easily transporting the multipurpose food and beverage container and insulated water dispensing alternative.

Still another objective of the invention is to provide a portable insulated storage container that has an easily assessable storage space that in either water dispensing mode or food and beverage cooler mode accommodates the inclusion of one or multiple ice packs in it content storage area.

It is an object of the invention to provide a unit comprised of the individual components and assemblies described above for the purpose described above to provide an multipurpose alternative to existing water dispensing units and cooler or ice chests.

These and other objects of the present invention will become readily apparent upon further reviewing of the specification and drawings.

DETAILED DESCRIPTION OF THE PREFERRED EMBODIMENT

Referring to FIG. 1 through 11 the present invention is a portable multipurpose food and beverage insulated container and insulated water dispensing alternative. The present invention combines a number of features which are meant to provide a multipurpose and convenient drinking source container and food and beverage storage and transporting solution. The present invention is shown to comprise: a Press Fit Lid Top Lid 1 or simply Press Fit Lid 1 which fits atop the Cooler Body 5, the Condensate Reservoir Support Tray 4 that sits in the Cooler Body 5 and supports the Non-Slip Surface Tilted Water Bottle Support Rack 2, above the Horizontal Content Support Rack 3 which is also supported by the Condensate Reservoir Support Tray 4. An optional Cup Support and Spill Reservoir Housing 8, which when installed, sleeve fits into the Cooler Body 5 suitably and is fixed from slipping out of position by a mate with the Condensate Reservoir Support Tray 4 inside the Cooler Body 5. Several accessories are permanently fastened to the Cooler Body 5, specifically the Nozzle or Spigot Access Door Hinge Assembly 7, the Nozzle or Spigot Access Door Latch Pivot Bar Mechanism 6, the Metallic Hemispherical Upper Nozzles or Spigot Access Door Opening Trim 14, Metallic Lower Nozzles or Spigot Access Door Opening Trim 15 and the Rubber Skid Strips 16 and the Cooler Body's Handle Supports 20.

Figure 1:
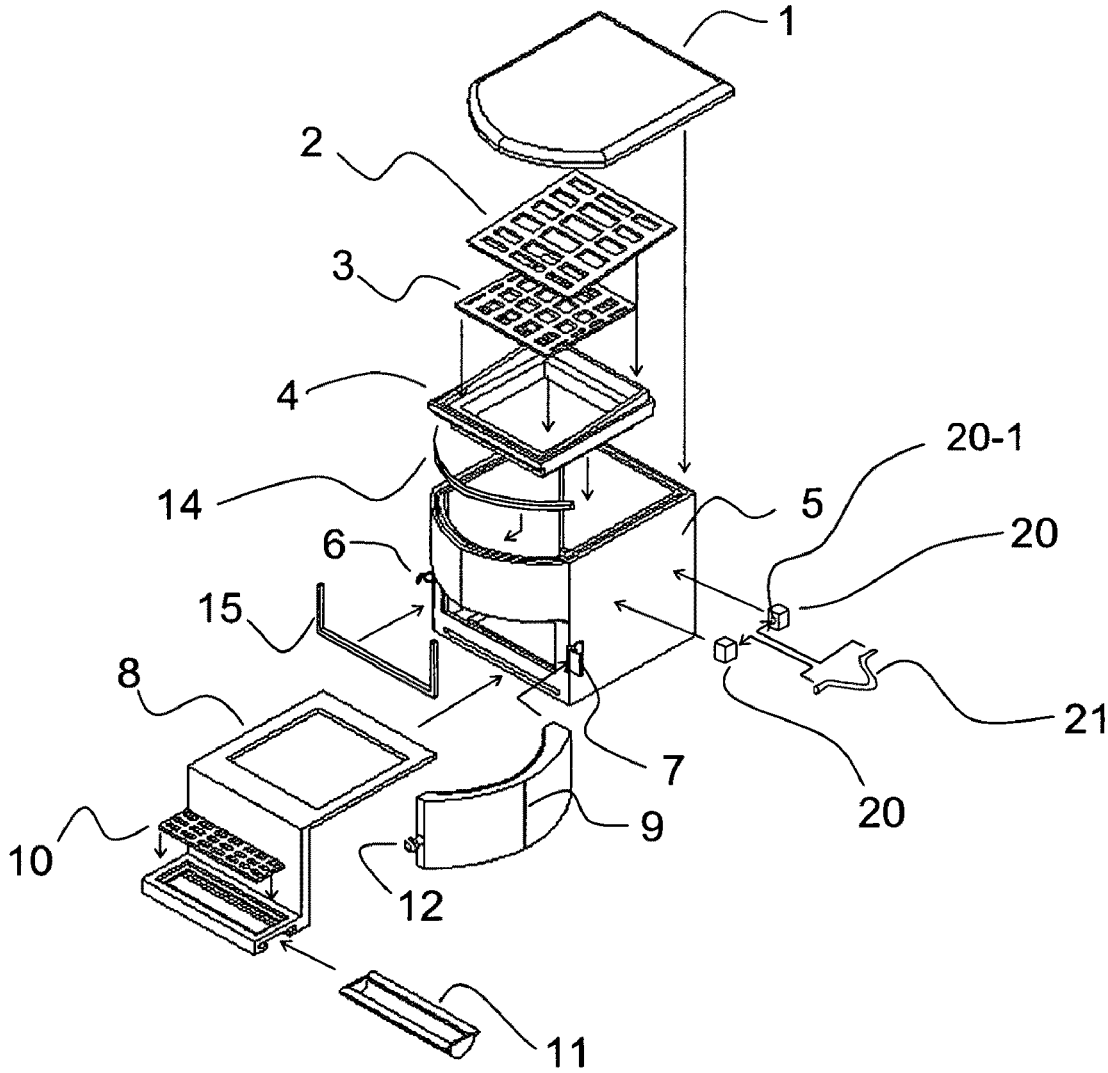
FIG. 1 is a top isometric assembly view, this isometric view of the preferred embodiment of the present invention is showing the portable multipurpose food and beverage insulator and water dispensing alternative in an unassembled formation displaying the general assemble concept.

Referring to FIG. 1 the Content Support Assemblage consist of a Condensate Reservoir Support Tray 4 that sits in the Cooler Body 5 and supports the Non-Slip Surface Tilted Water Bottle Support Rack 2, above the Horizontal Content Support Rack 3 which is also supported by the Condensate Reservoir Support Tray 4. The Cup Support and Spill Reservoir Assemblage consists of the Cup Support and Spill Reservoir Housing 8 which sleeve fits into the Cooler Body 5, Cup Support Rack 10 which anchors onto an indented section of the Cup Support and Spill Reservoir Housing 8 and the Spill Reservoir 11 which slides into a mating feature located on the Cup Support and Spill Reservoir Housing 8. Lastly the Door Latching Assemblage consist of the Nozzle or Spigot Access Door Latch Notch 12-1, the Nozzle or Spigot Access Door Handle 12 and the Nozzle or Spigot Access Door Latch Pivot Bar Mechanism 6 which is fastened to the Cooler Body 5.

Figure 2:
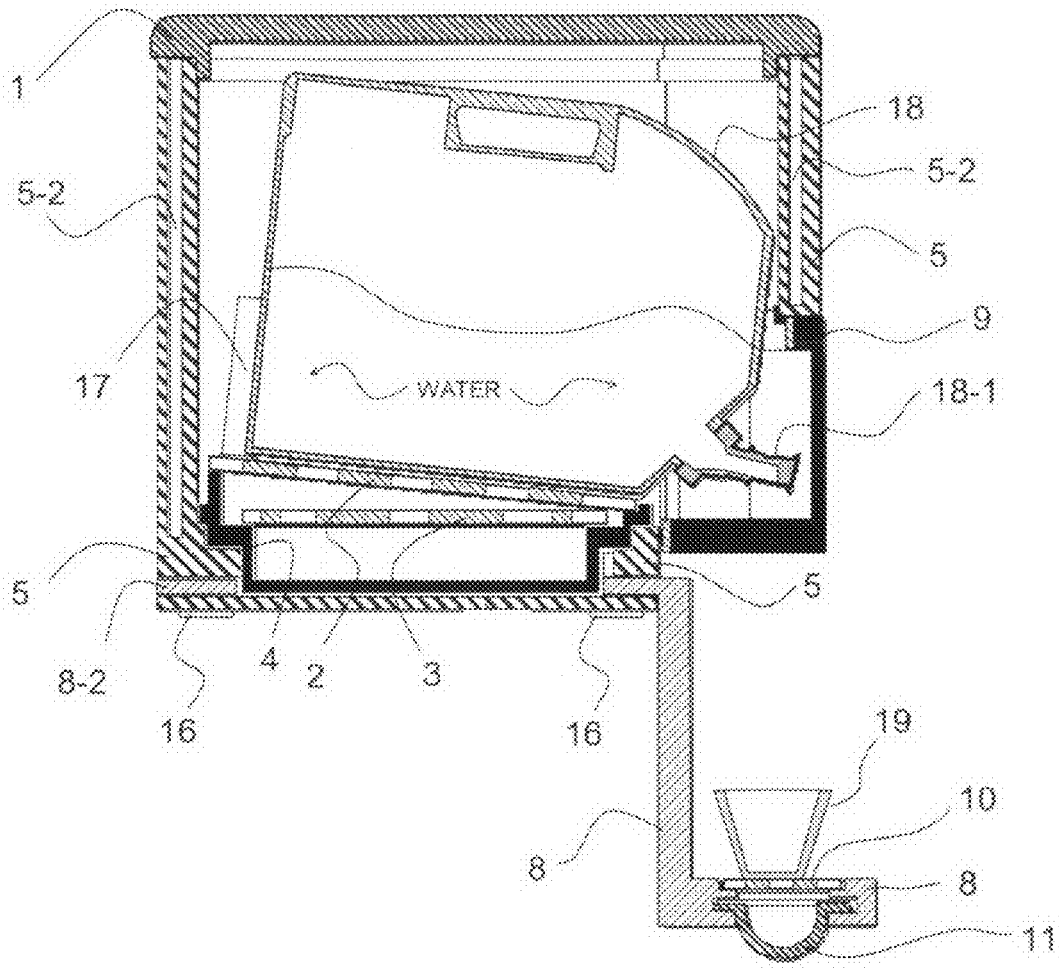
FIG. 2 is an elevation section view of the preferred embodiment portraying the fully assembled unit in cooler mode with the Dimensionally Appropriate Water Container present to increase the manufacturer's spatial awareness of the apparatus' function intent in an effort to clearly convey the assembled inventions functional utility.

Referring to FIG. 2 the present invention is a portable multipurpose food and beverage insulated container and insulated water dispensing alternative. Looking at the cross-sectional view of the Cooler Body 5 one is able to determine that the intended function of the design when used as a water dispenser is for the Cooler Body 5 to surround the water bottle and act as a partial enclosure to help impede heat transfer with the ambient air temperature. The fully insulating enclosure is formed by the addition of a Press Fit Lid 1 which covers the top of the Cooler Body 5 and the Nozzle or Spigot Access Door 9 which provides access to the Nozzle or Spigot 18-1 of the Dimensionally Appropriate Water Container 18. The Dimensionally Appropriate Water Container 18 sitting within the Cooler Body 5 is supported by the Non-Slip Surface Tilted Water Bottle Support Rack 2. Beneath the Non-Slip Surface Tilted Water Bottle Support Rack 2 is the Horizontal Content Support Rack 3. Both the Non-Slip Surface Tilted Water Bottle Support Rack 2 and Horizontal Content Support Rack 3 are supported by the Condensate Reservoir Support Tray 4. The Condensate Reservoir Support Tray 4 it-self is supported by the Cooler Body 5. Additionally, the Condensate Reservoir Support Tray 4 fits between the hollowed section of the Upper Horizontal Arm 8-2 of the Cup Support and Spill Reservoir Housing 8. The intention of the positioning of the Cup Support and Spill Reservoir Housing 8 around the lower section of the Condensate Reservoir Support Tray 4 is to fix the Cup Support and Spill Reservoir Housing 8 from lateral translational movement and rotational movement as well. Moreover out of insertion plane lateral translational movement is impeded by virtue of the sleeve fitted upper horizontal member of the Cup Support and Spill Reservoir Housing 8 within the Cooler Bodies Lower Insert Cavity 5-1 identified in FIG. 6. The function of the Cup Support and Spill Reservoir Housing 8 is achieved by the Cup Support Rack 10 being placed onto the Cup Support and Spill Reservoir Housing 8. The Cup Support Rack 10 supports the cup 19 and allows spilled water to pass through its mesh design into the Spill Reservoir 11. The Spill Reservoir 11 is sleeve fitted between the Lower Horizontal Member 8-2, shown in FIG. 8, of the Cup Support and Spill Reservoir Housing 8.

Figure 3:
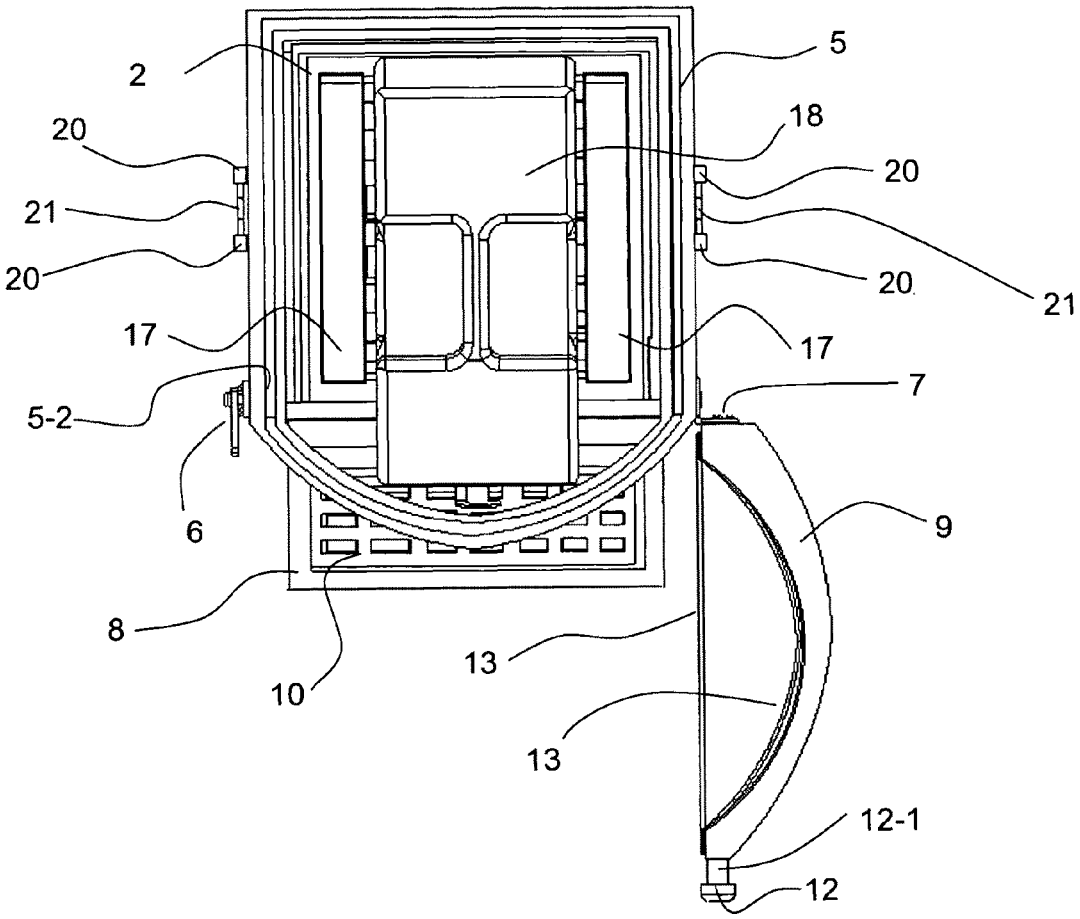
FIG. 3 is a top orthographic view of the preferred embodiment; this plan view shows the presented invention assembled with the top removed and the Dimensionally Appropriate Water Container's Nozzle or Spigot Access Door in an open position. The view is intended to convey the possibility of housing the Dimensionally Appropriate Water Container and ice pack within the same Cooler Body Content Storage Space.

Referring to FIG. 3 the present invention is a portable multipurpose food and beverage insulated container and insulated water dispensing alternative. The view shown in FIG. 3 is a plan view of the Dimensionally Appropriate Water Container 18 which further demonstrates the functionality of the unit when used in water dispenser mode. Shown in FIG. 3 are ice packs 17 placed in side of the Cooler Body 5 along with the Dimensionally Appropriate Water Container 18. This view illustrates the perspective of the user as her or she accesses the Cooler Body 5 storage space for the purpose of places the Dimensionally Appropriate Water Container 18 and ice pack 17 onto the Non-Slip Surface Tilted Water Bottle Support Rack 2.

Figure 4:
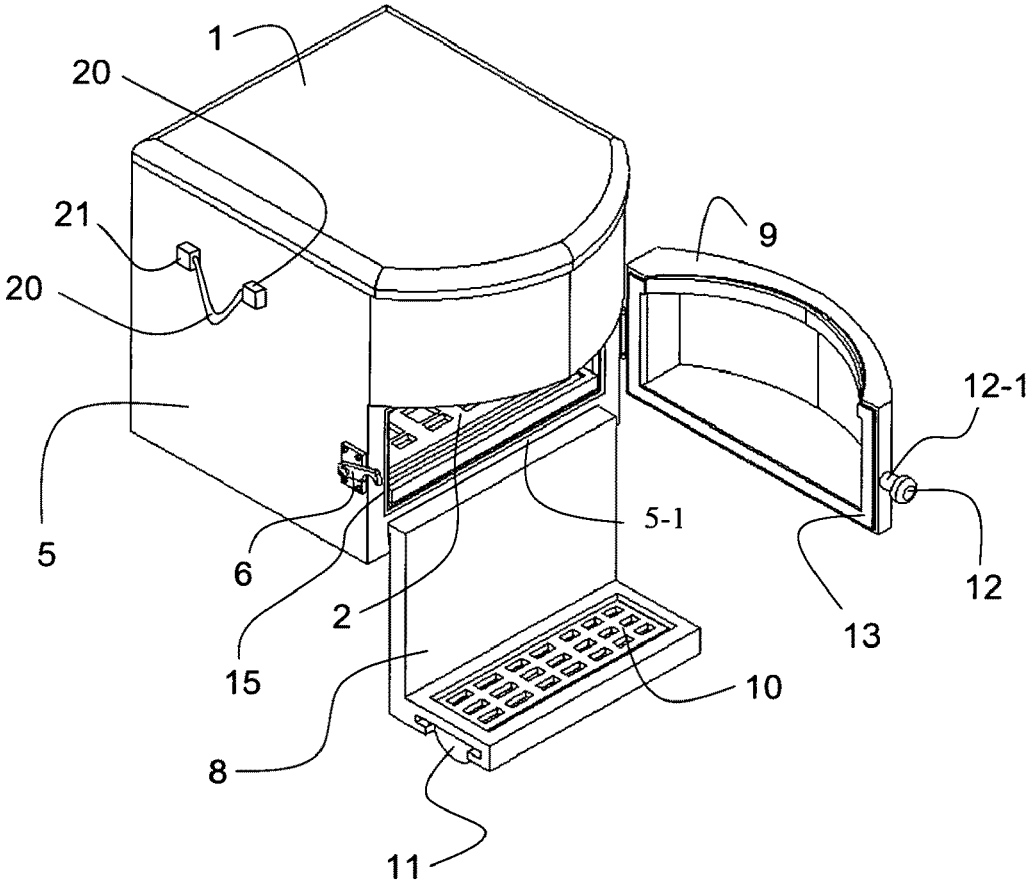
FIG. 4 the top isometric view is of the preferred embodiment fully assembled with the Dimensionally Appropriate Water Container's Nozzle or Spigot Access Door in an open position. The view conveys the position of the Nozzle or Spigot Access Door Latch Pivot Bar assembly which is fastened to the Cooler Body.

Referring to FIG. 4 the present invention is a portable multipurpose food and beverage insulated container and insulated water dispensing alternative. The view shows the apparatus fully assembled for water dispenser mode of operation. The Nozzle or Spigot Access Door 9 of the unit is shown in the open position or the water dispensing position. The Nozzle or Spigot Access Door 9 has attached to it a Magnetic Nozzle or Spigot Access Door Gasket 13 and a Nozzle or Spigot Access Door Handle 12. The cylindrical coupler serves as the Nozzle or Spigot Access Door Latch Notch 12-1. The Nozzle or Spigot Access Door Latch Notch 12-1 which is a part of the Nozzle or Spigot Access Door Handle 12 mechanism acts as the latching point upon which the Nozzle or Spigot Access Door Latch Pivot Bar 6 engages to secure the Dimensionally Appropriate Water Container's 18 Nozzle or Spigot Access Door 9 in the closed position. The Nozzle or Spigot Access Door Latch Pivot Bar 6 is fastened onto the side of the Cooler Body's 5 opposite the Nozzle or Spigot Access Door Hinge Assembly 7 using either screw or a suitable adhesive. Also fastened to the outer surface of the Cooler Body 5 using an adhesive or threaded fasteners are Transportation Handles Anchoring Supports 20 where in the Transportation Handles 21, when squeezed, displaces such that it achieves sufficient clearance for the Transportation Handles 21, shown in FIG. 1, to fit within the Handles Anchoring Supports Cylindrical Bores 20-1. The mate between Handles Anchoring Supports Cylindrical Bores 20-1 and the handle's anchoring members is a sleeve fit which permits rotation of the Transportation Handles 21 within the Handles Anchoring Supports Cylindrical Bores 20-1.

Figure 5:
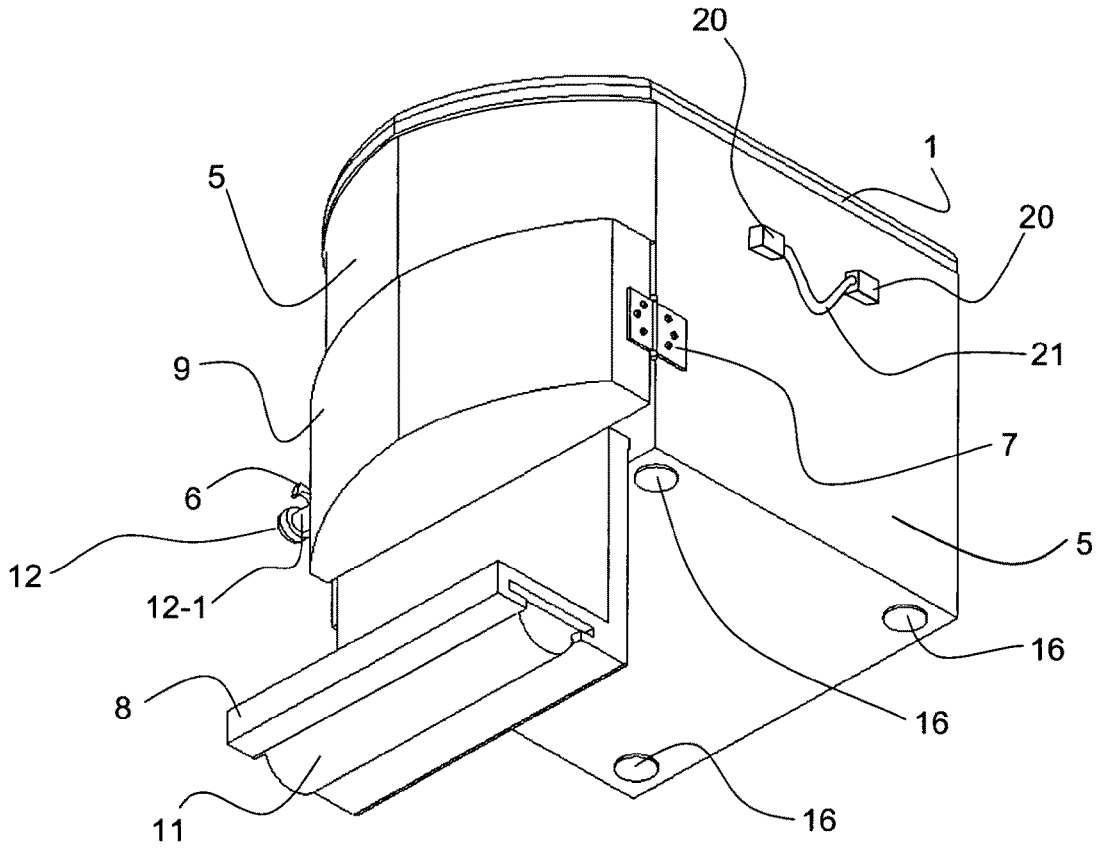
FIG. 5 is the bottom isometric view of the preferred embodiment showing a fully assembled unit in dispensing mode with the Nozzle or Spigot Access Door closed. This view's intention is to highlight the position of the Rubber Skid Strips in relation to the Cooler Body and the position of the Nozzle or Spigot Access Door Hinge Assembly in respect to the Cooler Body and Nozzle or Spigot Access Door.

Referring to FIG. 5 the present invention is a portable multipurpose food and beverage insulated container and insulated water dispensing alternative. The view shown in FIG. 5 is an isometric bottom perspective of the fully assembled apparatus for water dispensing mode. The view makes visible the Rubber Skid Strips 16 that are fastened to the Bottom Planar Surface 5E of the Cooler Body 5. The Rubber Skid Strips 16 can be fastened using an adhesive or fastener of choice. The intention of the Rubber Skid Strips 16 is to prevent unwanted movement of the unit when place on the surface of choice. Also visible in this view is the Cooler Body's Handle Supports 20 and Transportation Handle 21. Lastly one is able to see the Nozzle or Spigot Access Door Hinge Assembly 7, which facilitates the joining of the Nozzle or Spigot Access Door 9 to the Cooler Body 5.

Figure 6:
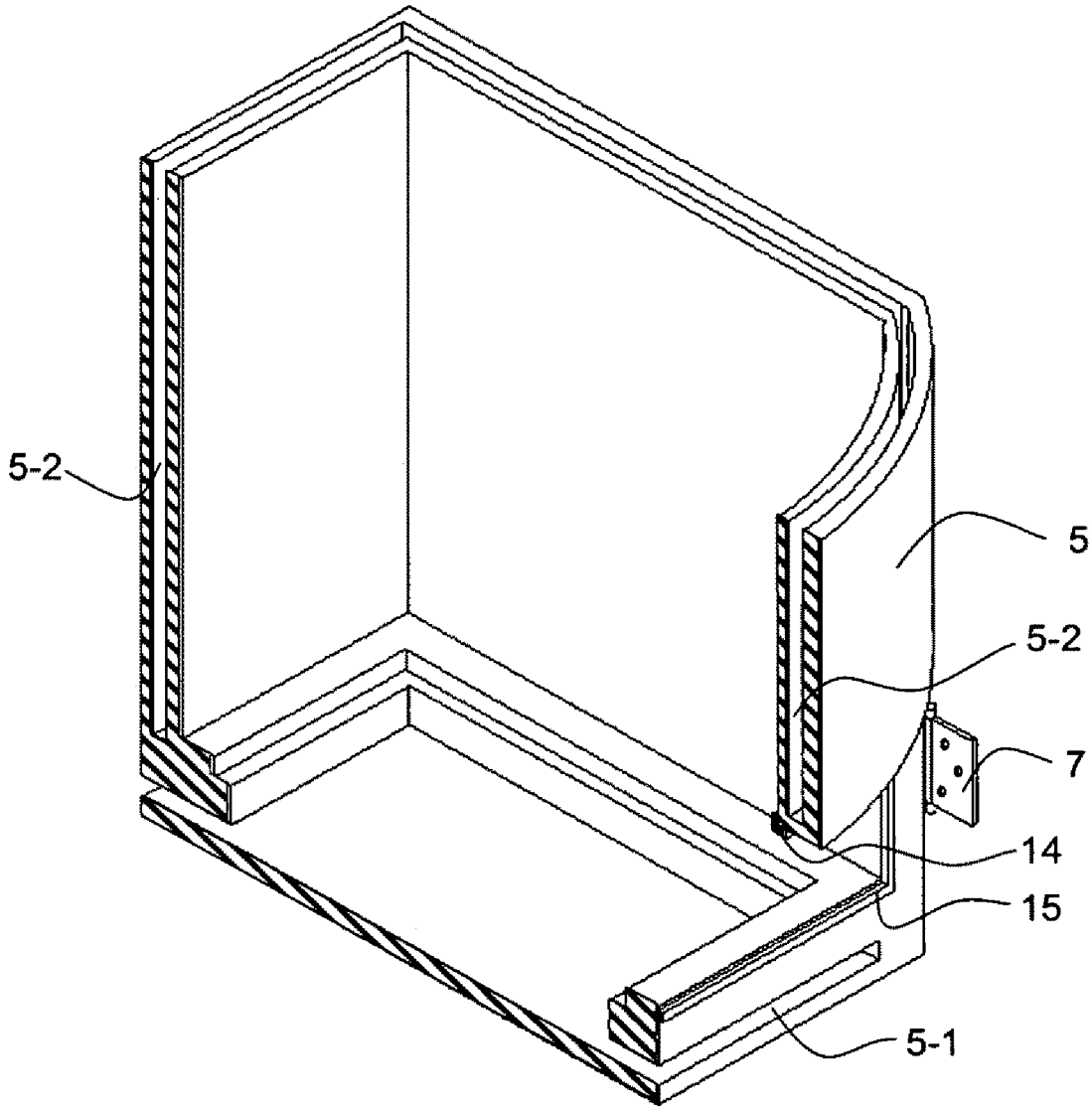
FIG. 6 is the top isometric section view of the Cooler Body with Nozzle or Spigot Access Door Hinge Assembly, and Magnetic Hemispherical Upper Nozzle or Spigot Access Door Opening Trim which is also attached to the Cooler Body. This view is intended to highlight the spatial organization of the Cooler Body in an effort to clearly convey the mating of components during assembly of the apparatus. Also visible is the position designated as the, Foam Insulation Cavity, for placement of foam insulation during manufacturing.

Referring to FIG. 6 the present invention is a portable multipurpose food and beverage insulated container and insulated water dispensing alternative. The view shown is an isometric section view of the Cooler Body 5 without any attachments. The Foam Insulation Cavity 5-2 found within the Cooler Body 5 is filled with insulation foam. The Cooler Body 5 is molded using plastic molding fabrication as are all the component which comprise the portable multipurpose food and beverage insulated container and insulated water dispensing alternative. In this view the Cooler Body 5 has attached to it: the Nozzle or Spigot Access Door Hinge Assembly 7, the Metallic Lower Nozzle or Spigot Access Door Opening Trim 15, and the Metallic Hemispherical Upper Nozzle or Spigot Access Door Opening Trim 14.

Figure 7:
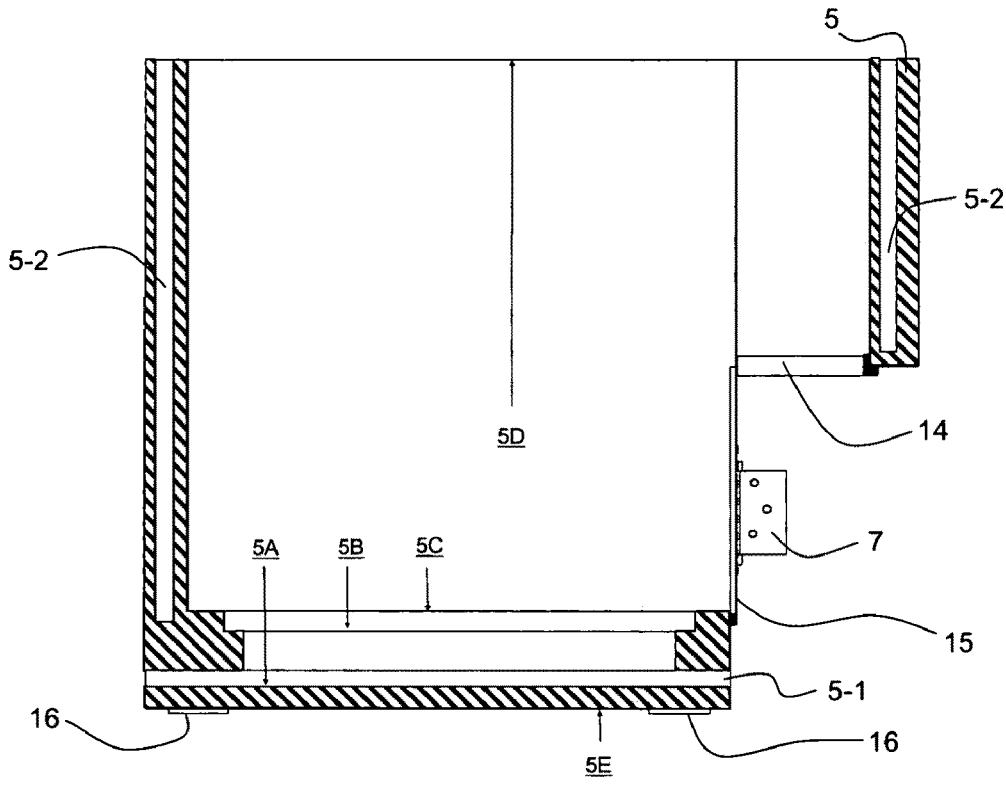
FIG. 7 is the elevation section view of the Cooler Body which further communicates the areas designated as the Foam Insulation Cavity and the mating surfaces for clarification of assembly.

Referring to FIG. 7 the present invention is a portable multipurpose food and beverage insulated container and insulated water dispensing alternative. The view shown is a sectioned elevation view of the Cooler Body 5 alone. The section view of the Cooler Body 5 is meant to highlight the surfaces of the Cooler Body 5 that will mate during the assembly of the apparatus. Surface 5A mates with the Upper Horizontal Arm 8-2 of the Cup Support and Spill Reservoir Housing 8. Surfaces 5B and 5C mate with the Condensate Reservoir Support Tray 4. Surface 5D mates with the Press Fit Lid 1.

Figure 8:
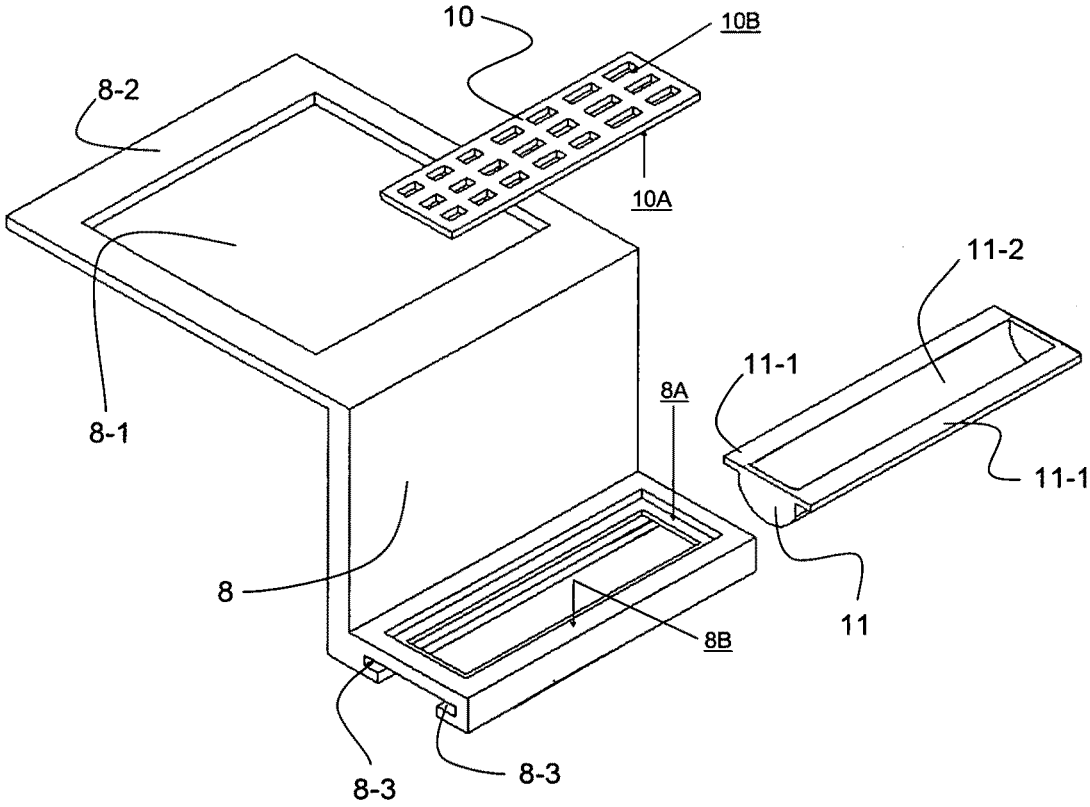
FIG. 8 is the assembly view of the Cup Support and Spill Reservoir Assemblage.

Referring to FIG. 8 the present invention is a portable multipurpose food and beverage insulated container and insulated water dispensing alternative. The view shown here is of the plastic molded Cup Support and plastic molded Spill Reservoir Housing 8. The Cup Support and Spill Reservoir Housing 8 has a rectangular opening 8-1 in its Upper Horizontal Arm 8-2 which creates a locking effect which the Condensate Reservoir Support Tray 4. The aforementioned locking effects occurs when the Condensate Reservoir Support Tray 4 is seated within the Cooler Body 5 between the rectangular opening 8-1 of the Spill Reservoir Housing 8 which was place in position by sliding the Upper Horizontal Arm 8-2 of the Spill Reservoir Housing 8 into the Cooler Bodies Lower Insert Cavity 5-1 before the Condensate Reservoir Support Tray 4 was seated, into the Cooler Body 5. Also present in the view is the Cup Support Rack 10 whose lower surface designated as surface 10A mates with surface 8A. Surface 10B seats the cup 19 whose base may extend onto surface 8B. However if the cup 19 placed onto surface 10B and/or 8B does not capture all of the fluid dispensed from the Dimensionally Appropriate Water Container 18 a portion of the spilled fluid will accumulate in Spill Reservoir's Well 11-2 which can later be removed for evacuating the accumulated spillage. The Spill Reservoir 11 has two Spill Reservoir Anchoring Flaps 11-1 which sleeve fits into the Lower Horizontal Arm Opening 8-3 this feature facilitate the removal of the Spill Reservoir 11 for emptying of the Spill Reservoir's Well 11-2

Figure 9:
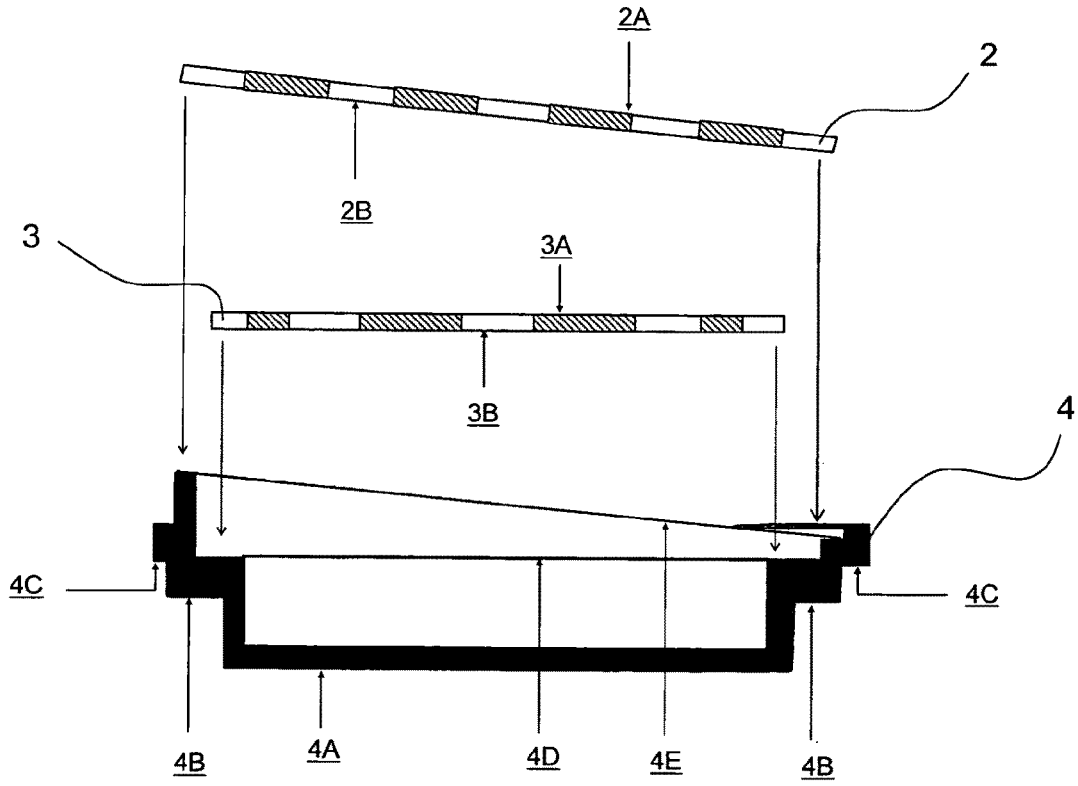
FIG. 9 is the elevation section view of the Content Support Assemblage. The view conveys the mating surfaces for clarification of assembly and usage instructions.

Referring to FIG. 9 the present invention is a portable multipurpose food and beverage insulated container and insulated water dispensing alternative. The view shown in the FIG. 9 is an elevation section of the Condensate Reservoir Support Tray 4, the Non-Slip Surface Tilted Water Bottle Support Rack 2, and the Horizontal Content Support Rack 3 all of which are the components which complete the Content Support Assemblage. The intention of this view is to identify the surfaces that will be mated in order to complete the assembly of the apparatus for water dispensing mode. The Condensate Reservoir Support Tray 4 is first mated by placing the Horizontal Content Support Rack 3 on top or the Condensate Reservoir Support Tray 4 such that surface 4D of the Condensate Reservoir Support Tray 4 touches surface 3B of the Horizontal Content Support Rack 3 all of which will be positioned below the Non-Slip Surface Tilted Water Bottle Support Rack 2. Next the Non-Slip Surface Tilted Water Bottle Support Rack 2 is mated against the Condensate Reservoir Support Tray 4 by allow surface 4E of the Condensate Reservoir Support Tray 4 to mesh with surface 2B of the Non-Slip Surface Tilted Water Bottle Support Rack 2. The aforementioned assembly is only necessary when the apparatus is being used for water dispensing. If the apparatus is being used for food and beverage insulating than the apparatus must be assembled by not including the Non-Slip Surface Tilted Water Bottle Support Rack 2 in the Content Support Assemblage subsequently the surface that will be used to support the cooler's content would be 3A opposed to the Dimensionally Appropriate Water Container 18 being place on surface 2A during dispensing mode. Other surfaces shown are surface 4C, 4B and 4A. Surface 4C and 4B are to loosely fit in the cooler body, refer to FIG. 2, while still enabling the fixing of the Spill Reservoir Housing 8 from undesirable movements. Surface 4A seats between the Cup Support and Spill Reservoir Housing 8 rectangular opening 8-1 and rests atop the Cooler body interior surface refer to FIG. 6 and FIG. 2.

Figure 10:
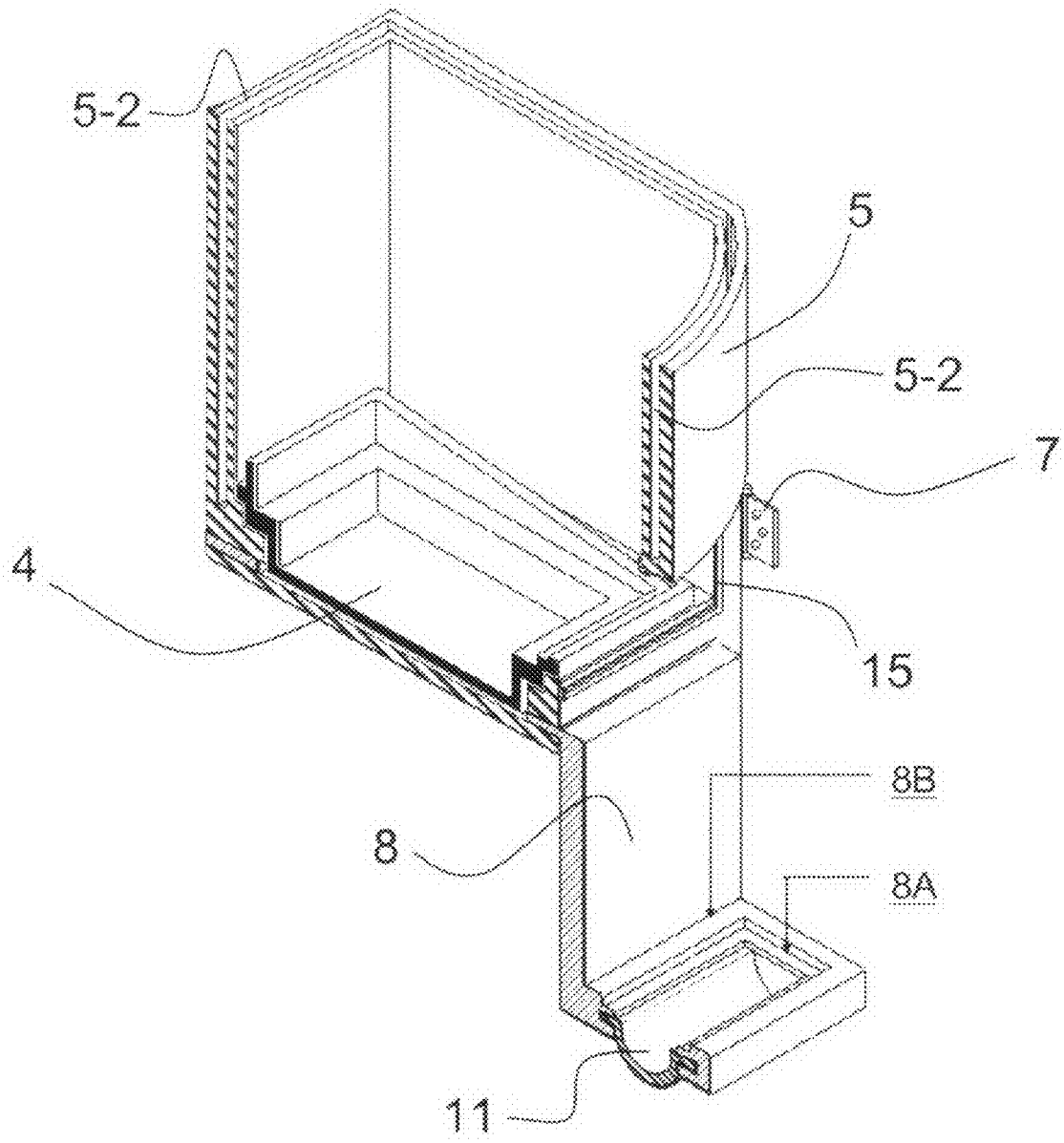
FIG. 10 is the section view of the Cooler Body, Cup Support and Spill Reservoir Assemblage and Content Support Assemblage.

Referring to FIG. 10 the portable multipurpose food and beverage insulated container and insulated water dispensing alternative. The image shown is an isometric section view of the unit partially assembled. The purpose of this view is to show how the Condensate Reservoir Support Tray 4 fits with in the Cooler Body 5. Additionally the Cup Support Rack's 10 mating Surface 8A is shown in this view.

Figure 11:
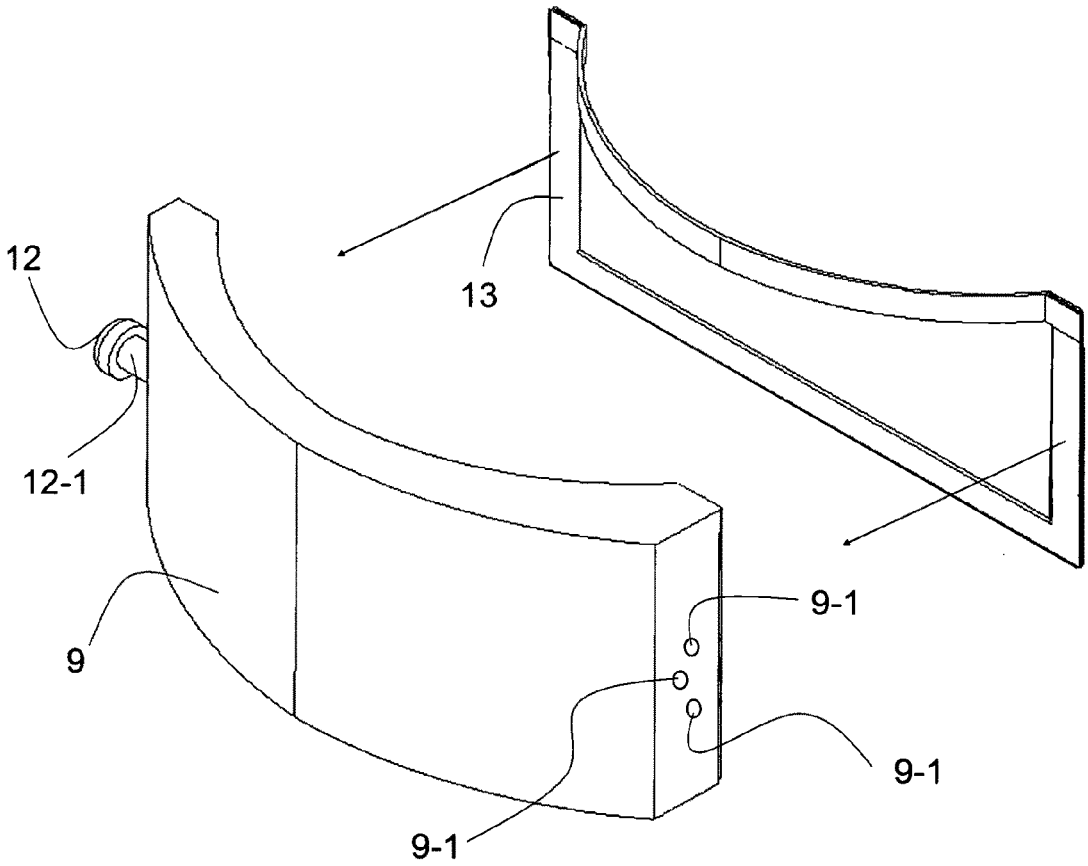
FIG. 11 is the assembly view of the frontally positioned Nozzle or Spigot Access Door and its Magnetic Nozzle or Spigot Access Door Gasket.

Referring to FIG. 11 the present portable multipurpose food and beverage insulated container and insulated water dispensing alternative. The image shown is an isometric assembly view of the Nozzle or Spigot Access Door 9 with the Nozzle or Spigot Access Door Handle 12 attached to the Nozzle or Spigot Access Door. The Door Handle 12 can be attached to the door using a threaded fastener or adhesive. The Magnetic Nozzle or Spigot Access Door Gasket 13 is shown properly oriented for mating with the Nozzle or Spigot Access Door 9. The Nozzle or Spigot Access Door Gasket 13 is fastened to the Nozzle or Spigot Access Door using an adhesive or a threaded fastener. FIG. 11 also shows the Threaded Holes 9-1 for inserting the fasteners which facilitate the mating of the Nozzle or Spigot Access Door 9 to the Nozzle or Spigot Access Door Hinge Assembly 7.

What is claimed as being new and desired to be protected is a follows:

1. I claim a portable multipurpose food and beverage insulated container and insulated beverage dispensing alternative apparatus comprising: a suitably rigid plastic cooler body with an open top covered by a press fit top lid, a suitably rigid content support assemblage, a friction enhanced material located on the exterior bottom planar surface of the cooler body, a beverage container with a nozzle inserted through the cooler's open top, a frontally positioned nozzle access door mounted on the frontal face of the cooler body which permits direct access to the beverage container's nozzle and a cooler body content storage space, an attachable and detachable cup support and spill reservoir assemblage, said content support assemblage including a removable horizontal content support rack and a removable non-slip tilted water bottle support rack wherein the content support assemblage is adjusted to support food and beverage storage or beverage dispensing modes of operation by adding or removing said horizontal content support rack or said non-slip tilted water bottle support rank from inclusion in the content support assemblage.

* * * * *